US006938615B1

(12) United States Patent
Walker et al.

(10) Patent No.: US 6,938,615 B1
(45) Date of Patent: Sep. 6, 2005

(54) ARROW SUPPORT DEVICE FOR ARCHERY BOW

(75) Inventors: Kevin P. Walker, Akron, OH (US); Terry Peake, Rochdale (GB)

(73) Assignee: Arrowglide, LLC, Akron, OH (US)

( * ) Notice: Subject to any disclaimer, the term of this patent is extended or adjusted under 35 U.S.C. 154(b) by 0 days.

(21) Appl. No.: 10/406,507

(22) Filed: Apr. 3, 2003

Related U.S. Application Data

(60) Provisional application No. 60/369,885, filed on Apr. 3, 2002.

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 4,803,971 A * 2/1989 Fletcher ..... 124/44.5
5,190,023 A * 3/1993 Sacco ..... 124/44.5
5,394,858 A * 3/1995 Karolian ..... 124/44.5
5,592,930 A * 1/1997 Roberts et al. ..... 124/44.5
5,603,309 A * 2/1997 Sheliga ..... 124/44.5
6,021,769 A * 2/2000 Troncoso ..... 124/44.5
6,082,348 A * 7/2000 Savage ..... 124/44.5
6,196,210 B1 * 3/2001 Chamberlain ..... 124/23.1

* cited by examiner

*Primary Examiner*—John A. Ricci
(74) *Attorney, Agent, or Firm*—Roetzel & Andress, LLP

(57) ABSTRACT

The support devices of the present invention are simple and inexpensive devices. They are for use on the arrow rest ledge of the handle of, e.g., a compound bow and are used in conjunction with conventional fixed and fall away arrow rests. They do not rely on automatic triggers or manipulation by the archer using the hand holding the handle prior to the release of the arrow. In one embodiment, a "pin" support device consists of straight pins fixed to a support base and positioned ahead of a fall away rest. In another embodiment, a "loop" support device, used with a fixed arrow rest device, uses a spring biased wire loop attached to a support base which goes over the arrow to keep the arrow on the arrow rest. The support devices either automatically fall away from the arrow or the arrow moves away from the support device so that there is no interference in the flight of the arrow or contact with the fletching as the arrow passes by.

20 Claims, 15 Drawing Sheets

ARROW SUPPORT DEVICE FOR ARCHERY BOW

CROSS REFERENCE TO RELATED CLAIMS

This application claims the benefit of the filing of U.S. Provisional Patent Application Ser. No. 60/369,885, entitled "Arrow Support Device for Archery Bow", filed on Apr. 3, 2002, and the specification thereof is incorporated herein by reference.

BACKGROUND OF THE INVENTION

This invention relates to archery devices. Specifically, it relates to a support device for attachment to a bow and for use in conjunction with an arrow rest.

Developments in the field of archery have resulted in a move away from the use of and reliance on the traditional arrow rest ledge that is found is part of the handle of an archery bow to support the arrow as it is drawn and aimed. Typically, the fletching on the arrow will touch or strike the arrow rest ledge as the arrow leaves the bow and this can result in shooting inaccuracies. This would be true whether the shooting is at targets in a competitive environment or in the field during hunting. The move is toward a more sophisticated, narrower, and less intrusive arrow rest. The narrow or minimal arrow rest is desirable because it means that there is a minimal contact of the arrow and its support as the arrow is drawn and released. But, the problem with using the smallest possible arrow rest is that before the arrow is drawn back, prior to release, the arrow can fall off the arrow rest because of the influence of wind or movement whether the archer is shooting at targets or hunting. When the arrow falls off, the shooter must take the time to replace it. In a timed target shooting event, this will tend to put further pressure on the shooter. If the shooter feels that the arrow is not stable on the arrow rest, it will be distracting and keep the shooter from giving their full attention to hitting the target.

The need to retain the arrow on the arrow rest or replace the arrow on the arrow rest, has lead to the development of a number of devices for that purpose. For example, U.S. Pat. No. 5,603,309 to Sheliga discloses a manually operated arrow holder and replacer which is operated by a moveable lever that mechanically links to a replacer which is moved into and out of an arrow holding position by the manually operated lever. In the non-holding position, the replacer acts like a cradle to catch the arrow if it falls off the arrow rest, while moving the lever will move the replacer to a vertical orientation to replace the arrow back on the arrow rest. The design operates by moving the replacer into a flat horizontal position when shooting and requires manipulation of the lever with one of the hands on the bow. U.S. Pat. No. 5,181,502 to Ray discloses the use of support legs mounted to the exterior side wall of a handle visor section of an archery bow where the support legs are used in conjunction with an alignment leg to guide an arrow between the guide legs and the alignment leg. U.S. Pat. No. 5,697,356 to Chappell discloses an arrow holder which has a trigger operated at the front of the handle and a retainer that holds the arrow against the bow as the arrow is drawn. Pressing a finger pull causes the retainer to rotate away from the arrow before the drawn arrow is released. U.S. Pat. No. 4,827,895 to Troncoso, Jr. teaches an arrow rest used in conjunction with a second device which is in the form of a blade bent up and forked or notched to blocking an arrow shaft that gripping it to prevent the arrow from rolling it off the rest. The blade is designed to be easily flipped down and out of the way when the vanes of an arrow just shot by the bow strike it.

Additional examples of support devices used in association with arrow rests and which function like those discussed earlier include U.S. Pat. No. 5,944,005 to Schiff; U.S. Pat. No. 5,611,323 to Townley; U.S. Pat. No. 6,035,842 to Bradley; U.S. Pat. No. 5,454,362 to Cook; U.S. Pat. No. 4,949,699 to Gerber; U.S. Pat. No. 5,678,530 to Van Drielen; U.S. Pat. No. 5,235,958 to Laffin; and U.S. Pat. No. 4,865,007 to Saunders.

While most of these patents recognize that some devices are necessary to stabilize the arrow and hold it in position prior to its release, they also recognize that if the device remains in position, they will interfere with the flight of the arrow or produce some contact such as with the fletching which can change the flight of the arrow. Therefore, these devices have been developed with a lot of sophistication. For example, these devices rely on the movement of the arrow or strings to trigger the release of the holder or guide device. Alternatively, these devices rely on manually operated trigger devices that are operated by the archer and located near the handle or riser of the bow to move the retention device from the path of the arrow just prior to its release. The problem with these devices is that the additional step that the archer must take is distracting and the physical step of triggering imparts unnecessary motion during the shooting process. Also, the triggering of the release of the holder imparts motion as well.

Arrow rests which minimize the contact with the arrow while providing support have generally fallen into two categories. These include fixed arrow rests and fall away or drop away arrow rests. Examples of fixed arrow rests providing nominal contact include U.S. Pat. No. 6,058,919 to Davis; U.S. Pat. No. 6,021,769 to Troncoso; U.S. Pat. No. 5,722,381 to Mizek; and U.S. Pat. No. 6,050,251 to Harwath et al. These type of rests are not absolutely fixed in that they are usually spring tensioned and adjustable depending upon the arrows being shot and other factors. Further, the arrow rest is not necessarily a single support, but could be such. Often, the arrow rest may consist of two support pieces that are spaced apart and allow the fletching on the arrow to shoot through the gap.

The "fall away" or "drop away" arrow rest supporting the arrow in a manner similar to the fixed arrow rest but operates by having the arrow rest is fixed to a rotating shaft. The shaft will rotate usually using an actuator cord tied to, for example, the tuning strings of a compound bow. As the arrow and tuning strings are drawn back, the actuator cord is also drawn rearward, causing the support shaft for the arrow rest to rotate which, in turn, causes the arrow rest that is fixed to the support shaft to move and raise the support point for the arrow. The arrow rest will rise from a generally horizontal orientation toward a more vertical orientation through an arc of approximately 45°. When the arrow is released, the tension on the actuator cord is released, and the arrow rest moves back in a direction of the riser. This is accomplished by a spring, magnets, or similar devices that go into compression due to the pull of the cord and the compressive force acts to move the arrow rest when the tension of the cord is released. This allows the arrow rest to fall or drop away from the arrow back to its rest position. The arrow which is now released in flight has nothing in its path to touch or interfere with its flight. Examples of fall away arrow rests include U.S. Pat. No. 6,044,832 to Piersons, Jr.; U.S. Pat. No. 4,453,528 to Eckert; U.S. Pat. No. 6,202,635 to Evans; and U.S. Pat. No. 5,490,492 to Savage.

SUMMARY OF THE INVENTION

The present invention is the result of the discovery that a simple support device for use on the arrow rest ledge of the handle of a compound bow and in combination with an arrow rest will keep the arrow on the arrow rest despite the action of wind and motion on the arrow before it is shot. In one embodiment, a "pin" support device in employed that consists of straight rods or pins fixed to a support base and positioned ahead of a fall away rest. The rest is described as "fall away", but it actually lift up as the arrow is drawn back and then falls away on release of the arrow. The support device will maintain the arrow on the arrow rest when the arrow is not drawn, but when the arrow is in the fully drawn position, the support device will not be in the position to interfere with the flight or the fletching of the arrow.

In another embodiment, a "loop" support device, is used with a fixed arrow rest device, and comprises a wire which will loop over the arrow when it is not drawn to keep the arrow on the arrow rest. A "fixed" arrow rest is also one that falls away, in that it is in a relatively fixed position when and as the arrow is drawn back, but falls away upon release of the arrow. Both the "pin" and "loop" support devices are used with "drop away" arrow rests and that term will be used for both. Although, the lift up and drop away arrow rest is preferred for use with the "pin" support device. The loop is attached to a support base and is spring-biased to fall off the arrow when the arrow is in the drawn position. In use, the support device is looped over the arrow (or the arrow is passed through the loop) so that the loop rotates from a generally horizontal orientation to a more vertical orientation. The spring tension keeps the loop on the arrow to hold it in place on the arrow rest until it is in a fully drawn position. As the arrow is drawn back towards the fully drawn position, the tip of the arrow will move past the loop and the loop will fall away from the arrow automatically due to the spring tension. When the loop is employed with broadhead arrows, the rollers or wheels can be added to the loop so that the rollers will rotate on the axis of the loop. This will facilitate the passage of the loop over the broadhead arrow point.

The support devices of the present invention are simple and inexpensive devices. They do not rely on automatic triggers or manipulation by the archer using the hand holding the handle prior to the release of the arrow. They automatically fall away or the arrow moves away from the support device so that they will not interfere in the flight of the arrow or contact the fletching as the arrow passes by.

BRIEF DESCRIPTION OF THE DRAWINGS

For a complete understanding of the objects, techniques and structure of the invention, reference should be made to the following detailed description and accompanying drawings, wherein.

DETAILED DESCRIPTION OF THE INVENTION

As noted, the present invention is directed to a support device for use on a bow, preferably a compound bow, although it is not limited to such use and can be used on other types of bows. For convenience, the invention will be described as used on a compound bow. Further, the device is used with an arrow rest and keeps the arrow on the rest until the arrow is drawn for shooting.

Figure 1:
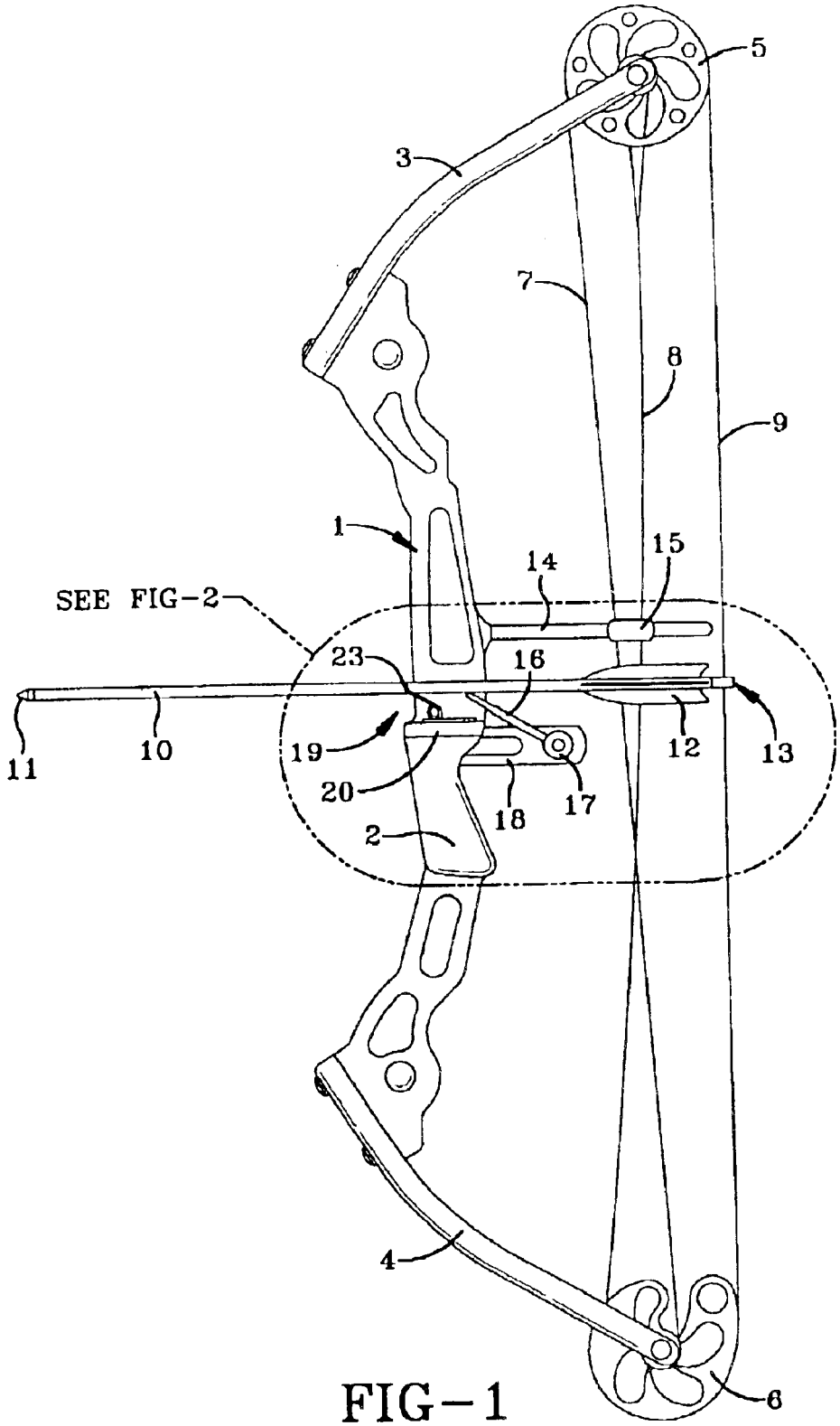
FIG. 1 is a side view of a compound bow employing a loop support device in accordance with the present invention.

FIG. 1 shows a compound bow employing one embodiment of the support device of the present invention. The bow shown is a typical compound bow having a riser section 1, handle 2, limbs 3 and 4, an idler wheel 5, a compound cam 6, and being strung such that there is an upwardly acting tuning cable 7, a downwardly acting tuning cable 8, and a bow string 9. Also shown is an arrow 10 having a tip 11, a fletching 12, and a knock 13 which is attached to bow string 9. As is typical in a compound bow, also present are a cable guide 14 and a cable slide 15.

The bow also employs an arrow rest 16 which is in held in a relatively fixed position by a support shaft 17 which is attached to the handle 1 or the riser 2 via a bracket 18. The arrow rest 16 may be adjusted by rotating the support shaft 17 in a clockwise or counter-clockwise direction via an adjustment mechanism that is known in the art but is not shown. The fixed arrow rest supports are known in the prior art and is use of a particular fixed arrow rest is not critical to the present invention.

Figure 2:
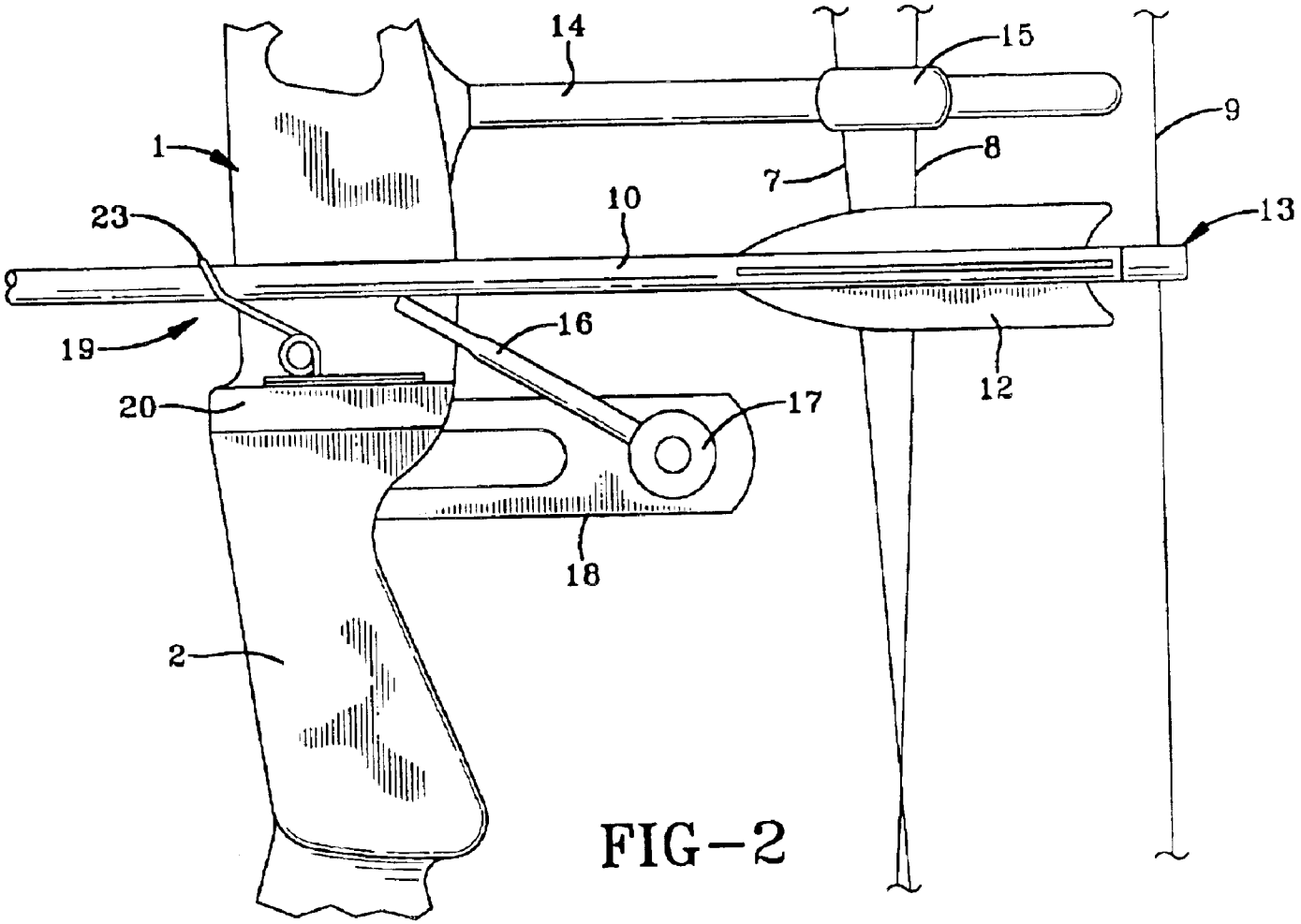
FIG. 2 is a detailed view of the riser section of the bow shown in FIG. 1 employing a loop support device in accordance with the present invention.
Figure 5:
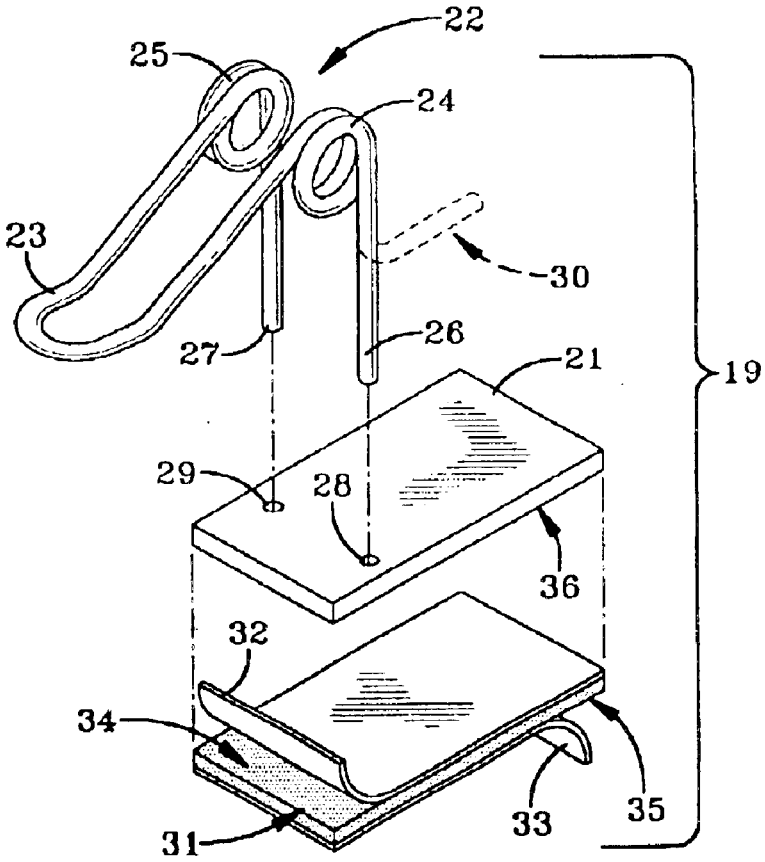
FIG. 5 is an exploded view of one embodiment of a loop support device of the present invention.
Figure 6:
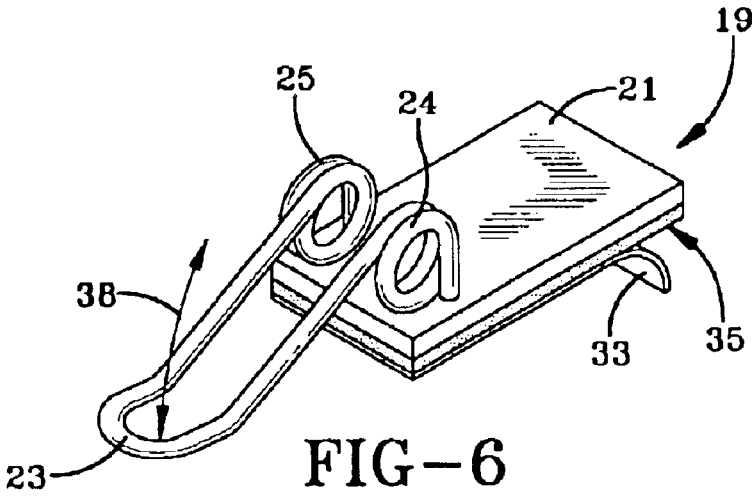
FIG. 6 is an isometric view of one embodiment of a loop support device in accordance with the present invention.

The loop support device in the embodiment shown in FIGS. 1, 2, and 6 is generally indicated by the numeral 19 in FIG. 1. As seen in FIGS. 5 and 6, the support device consists of a base 21 combined with a wire support device 22 which is attached to base 21. The support device can be made from a single piece of wire, bent so that a U-shaped support section 23 is attached to a pair of spring sections 24 and 25 which, in turn, are attached to legs 26 and 27. The shape of the wire loop is not critical. The shape is generally U shaped, but it does not have to be a narrow U-shape as shown in FIG. 6. It could be described as more toward semi-circular in shape, which for the purposes of this application will be referred to as "U-shaped". The open part of the "U" is then attached to the base. The size is not critical although the loop should define an opening large enough to accommodate an arrow and will preferably be in the range of about 5 to 13 millimeters in diameter. The device is assembled by passing legs 26 and 27 through holes 28 and 29 in base plate 21 and bending the legs back toward the bow string as shown by dotted lines of bent leg 30. Leg 27 will be bent in the same way. The general orientation of the device is such that the U-shaped section 23 or loop will point away from the bowstring. The base plate 21 can be affixed to the arrow rest ledge 20 of handle 2, for example, using a double-sided adhesive foam pad 31 having release sheets 32 and 33 which are removed to expose the adhesive surfaces 34 and 35. Surface 35 would be adhered against the arrow rest ledge 30 of handle 2, while surface 34 would be adhered to the underside 36 of support base 21. The base of the spring biased loop 19 could be attached to the arrow rest ledge 20 by other means such as screwing, nailing, using snaps, using magnets, using hook-and-loop fastener, or the like, or need not be attached to base plate 21 at all. Loop 19 could be attached directly to arrow rest ledge 20 by, for example, fixing legs 27 and 28 to ledge 20 using an adhesive or other bonding composition or by embedding or fixing legs 27 and 28 in the upper surface of ledge 20. The benefit of using a base plate is that the guide device can be placed where the user desires it or where it is appropriate if short arrows are being used. The use of the base plate provides flexibility and versatility.

Figure 15:
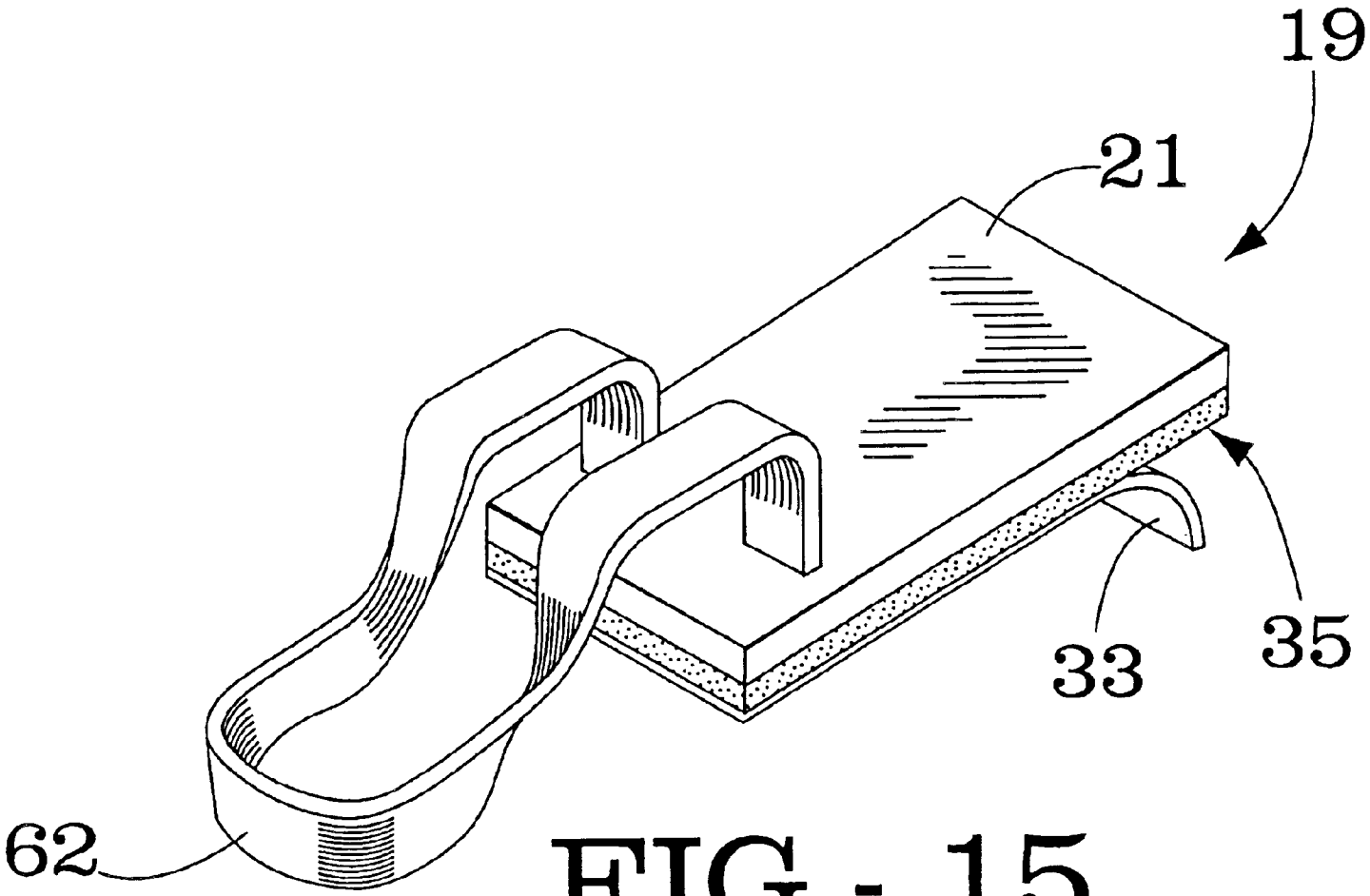
FIG. 15 is an isometric view of another embodiment of a loop support device in accordance with the present invention which illustrates a loop and spring coil made from flat spring wire.
Figure 16:
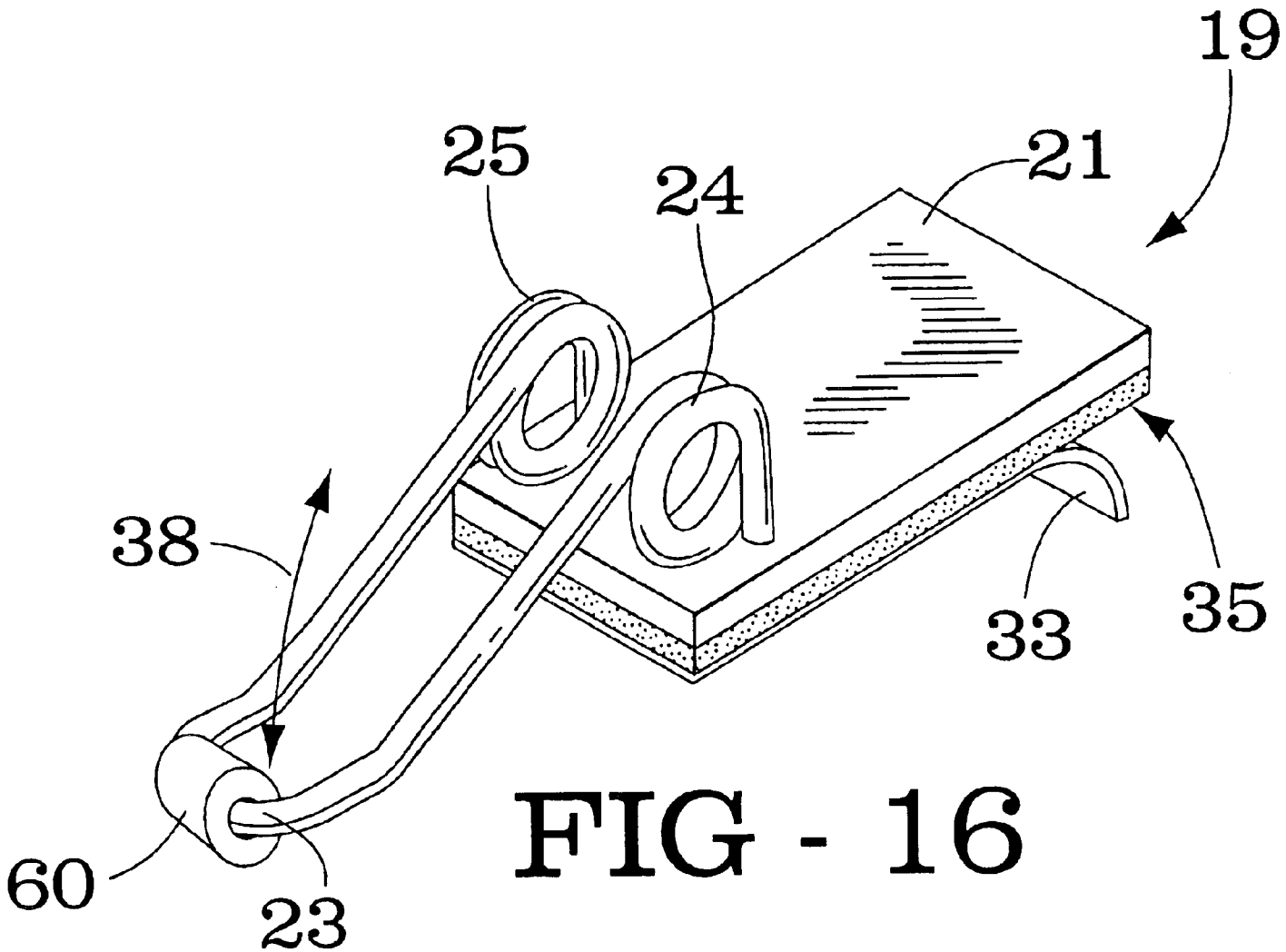
FIG. 16 is an isometric view of another embodiment of a loop support device in accordance with the present invention which employs a roller at the end of the loop.

The loop support device, including the loop and the base, can be made from a variety of materials, including aluminum, copper, steel, and plastic. The base, as well as the loop, can be coated or provided with a variety of colors and finishes. For example, it may be desirable to have a less reflective or a dark color finish when the bow is used for hunting so the guide is not visible to prey or reflective of sunlight. It preferred that the loop be made from a light weight sturdy material such as steel wire having a thickness of 0.001 to 0.01 inch, with about 0.0029 inch wire being further preferred. The thickness of the wire is not critical since the same spring tension can be achieved by varying the turns of the coil. For example, a thicker wire would use less turns, while a thinner wire would use more turns to produce the same spring tension. Further, although a "U" shape is shown for the loop, other geometries are contemplated and could be employed. For example, the loop could have a square shape, a rectangular shape, a triangular shape, or the like geometries. Still further, the loop support device could be formed from one piece of wire as shown and is preferred, or could be made from separate pieces which are assembled. For example, the spring mechanism need not be a double torsion spring as shown and other spring mechanisms can be employed. Thus, for example, the spring mechanism could be a single spring attached to a support member to provide the bias for a "loop" used to hold the arrow on the arrow rest to move to a rest position which does not interfere with the flight of the arrow. Alternatively, the spring could be a flat coil spring or springs and the loop and spring coils could be made from one or more pieces of flat spring wire such as wire 62, as shown in FIG. 15. Still further, the loop could employ wheels or rollers which rotate around the axis of the loop wire and which facilitate the passage of the loop over the arrow point of the arrow such as roller 60 illustrated in FIG. 16. This might be particularly helpful where the arrow head is a broadhead.

Figure 3:
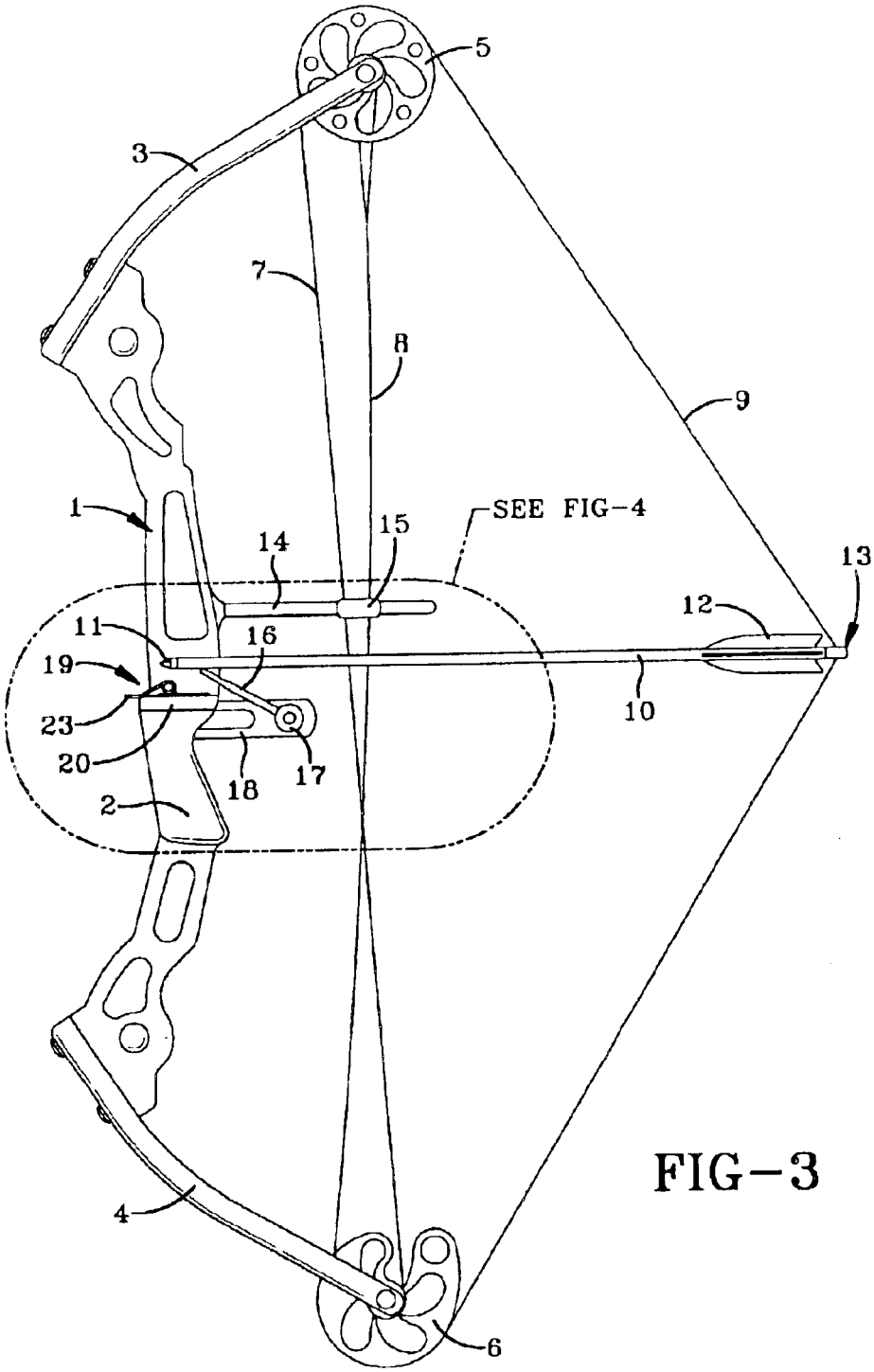
FIG. 3 is a side view of a compound bow employing a loop support device in accordance with the present invention, but shown in the fully drawn position.
Figure 4:
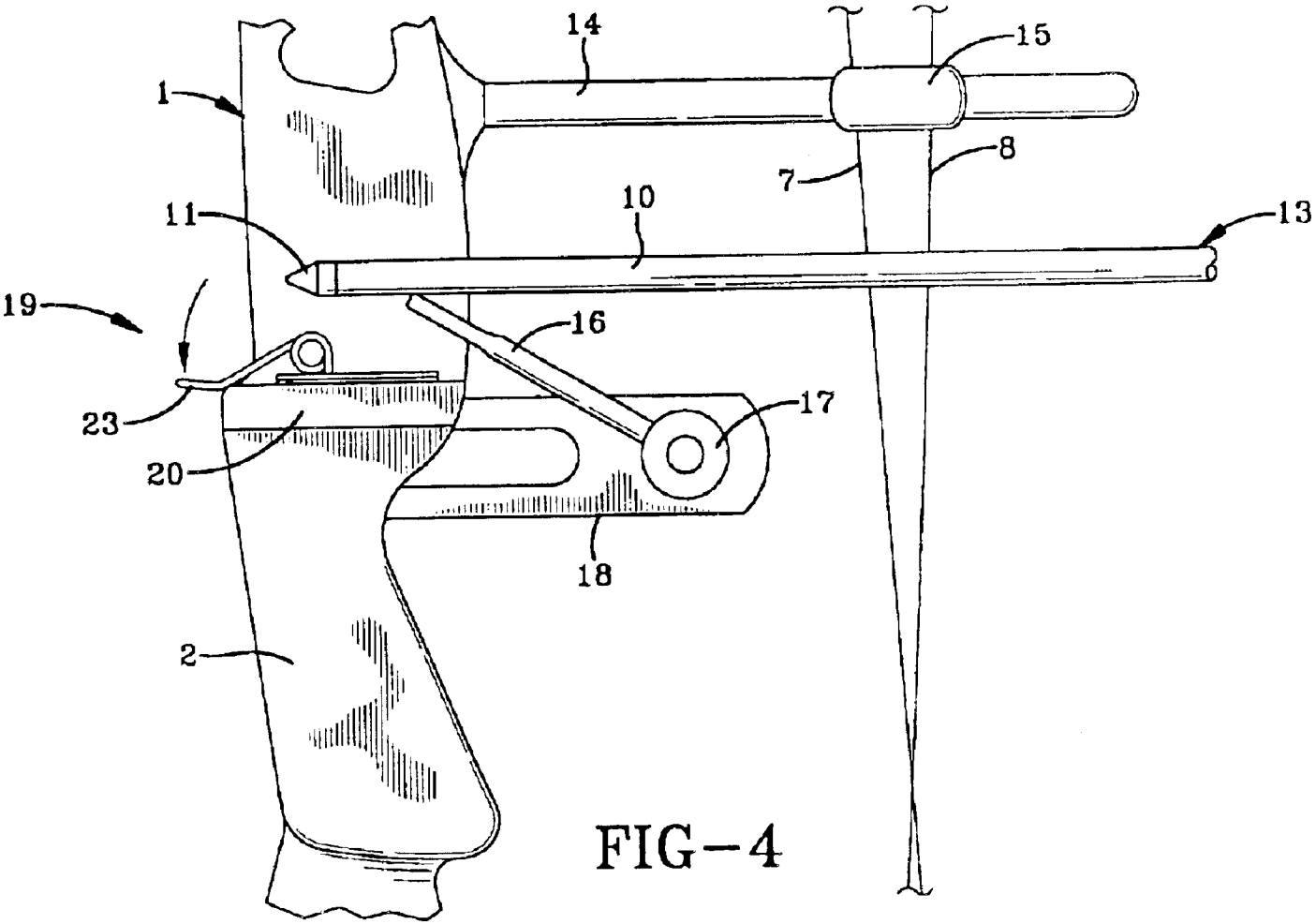
FIG. 4 is a detailed view of the riser section of the bow of FIG. 3.

The use of an adhesive pad allows the support device to placed in different locations on the arrow rest ledge, depending upon the length of arrows employed or other choices or conveniences of the shooter. As shown in FIG. 6 by arrow 38, the U-shaped part of the loop support device is moveable up, or pivots, by operating against the springs 24 and 25 and, when released, the springs will return the U-shaped portion back to a rest position as shown. With reference to FIGS. 2 and 4, the arrow is placed through the support device 22, a U-shaped portion 23 of the support device serves to hold arrow 10 when it is nocked, but not drawn. In this way, wind or movement or contact with bushes, for hunters, will not make the arrow fall off the arrow rest 16 due to the restraint of the loop. When the arrow is in the drawn position, as is shown in FIGS. 3 and 4, the tip 11 of the arrow is reached and the loop will slide or fall off the end of the arrow and return to the rest position because of the bias of the springs 24 and 25. At this point, the arrow is fully drawn and the weight of the arrow will maintain the arrow on the arrow rest. Once the arrow is released, the support device has moved out of the way and will not interfere with the flight of the arrow nor touch the fletching of the arrow. Further, because the device of the present invention can be made with small gauge wire, the forces involved in restraining the arrow and returning the device to its rest position are very slight. The movement of the loop off of the tip of the arrow is not enough to be a distraction to the shooter or influence the flight of the arrow.

Figure 8:
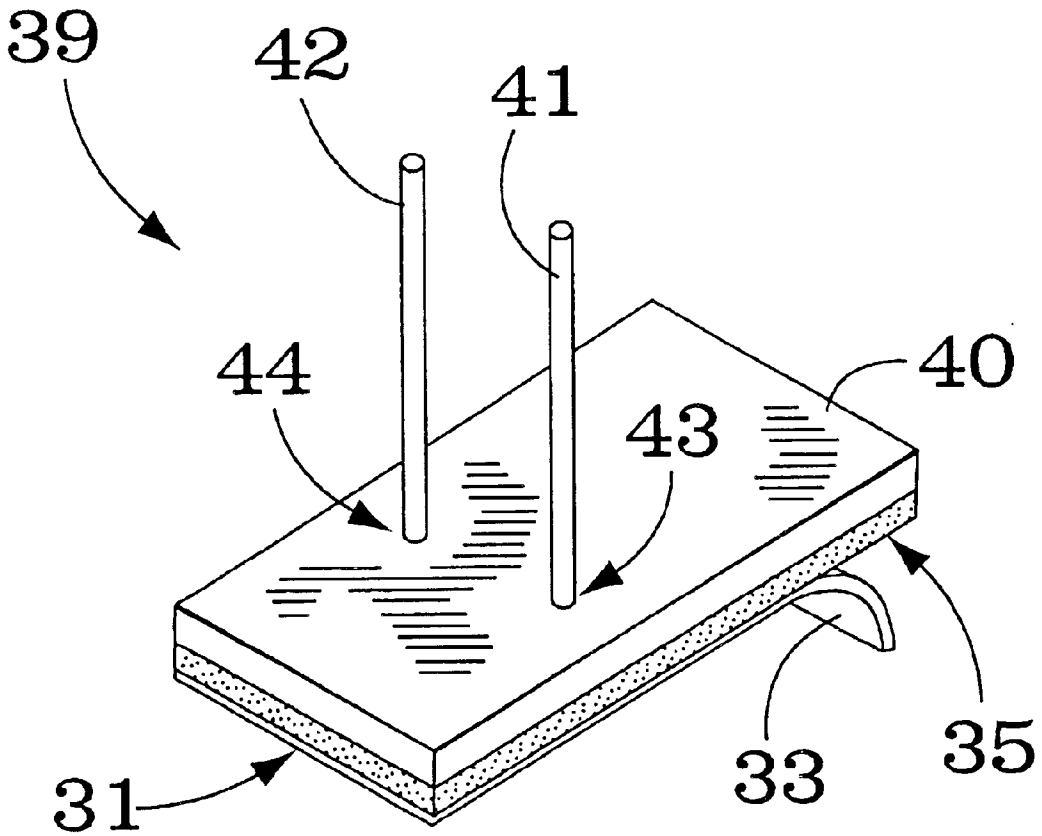
FIG. 8 is an isometric view of an embodiment of a pin support device in accordance with the present invention which illustrates generally-cylindrical pins.
Figure 10:
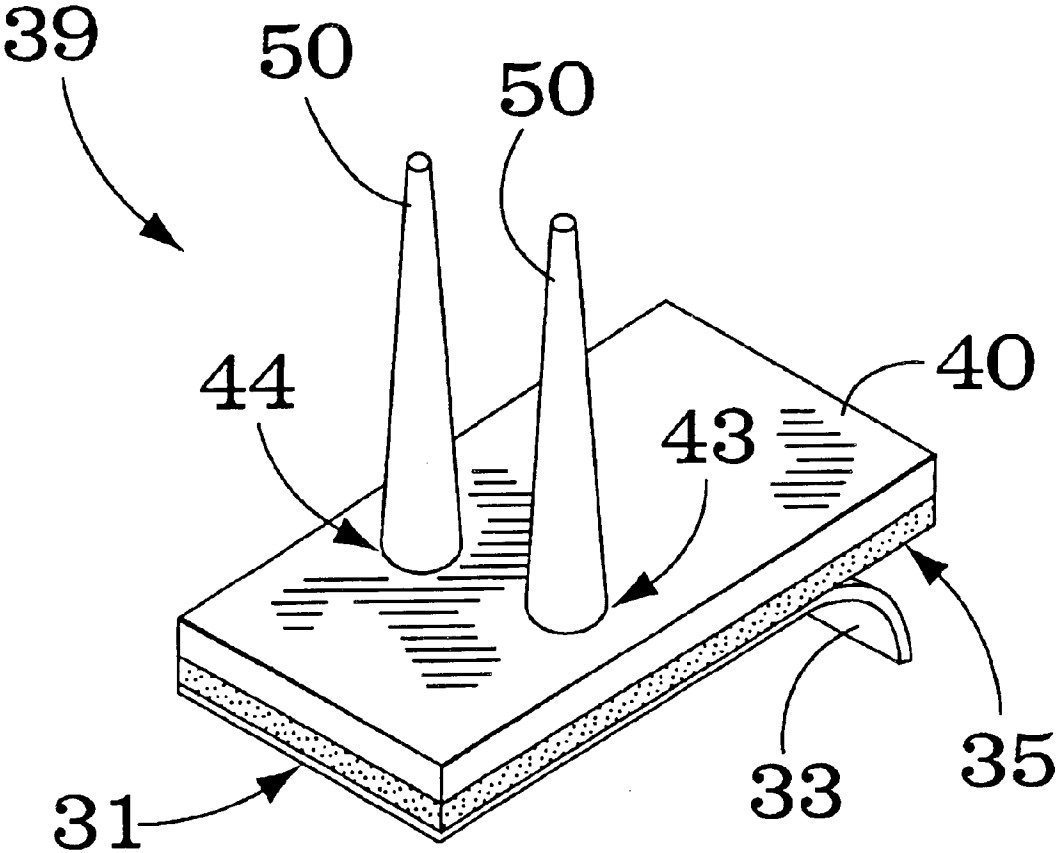
FIG. 10 is an isometric view of another embodiment of a pin support device in accordance with the present invention which illustrates tapered pins.
Figure 11:
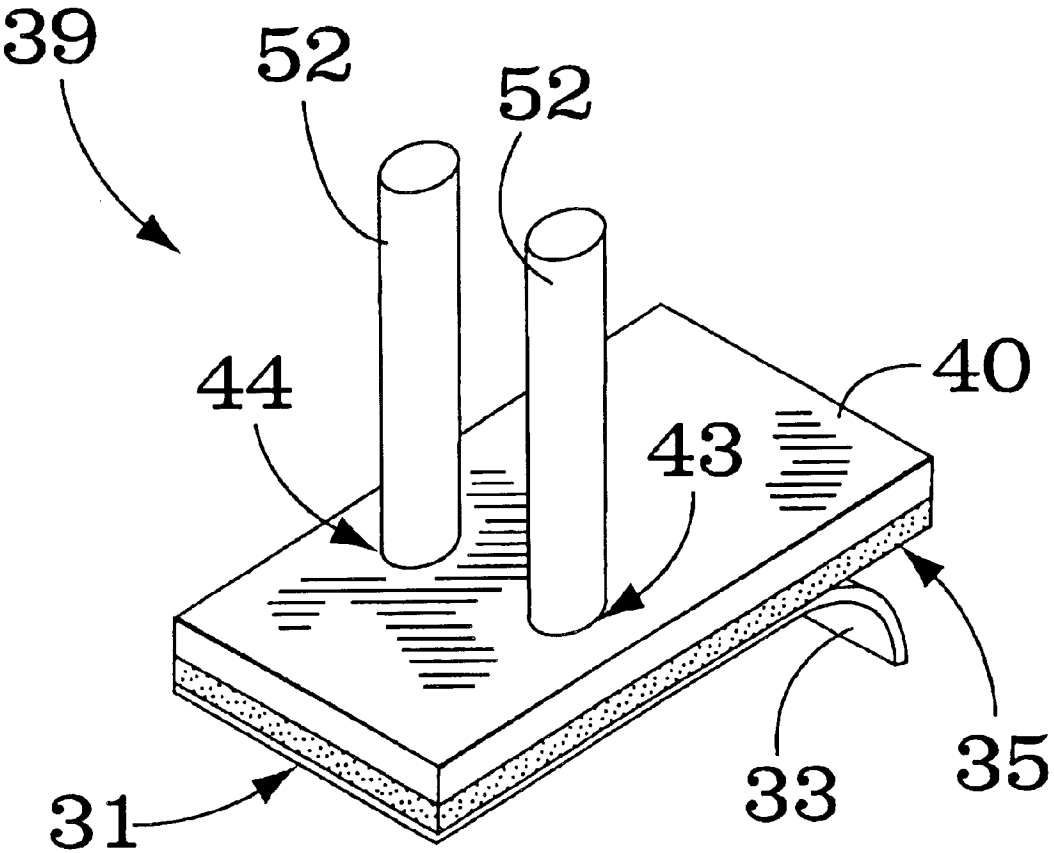
FIG. 11 is an isometric view of another embodiment of a pin support device in accordance with the present invention which illustrates oval pins.
Figure 12:
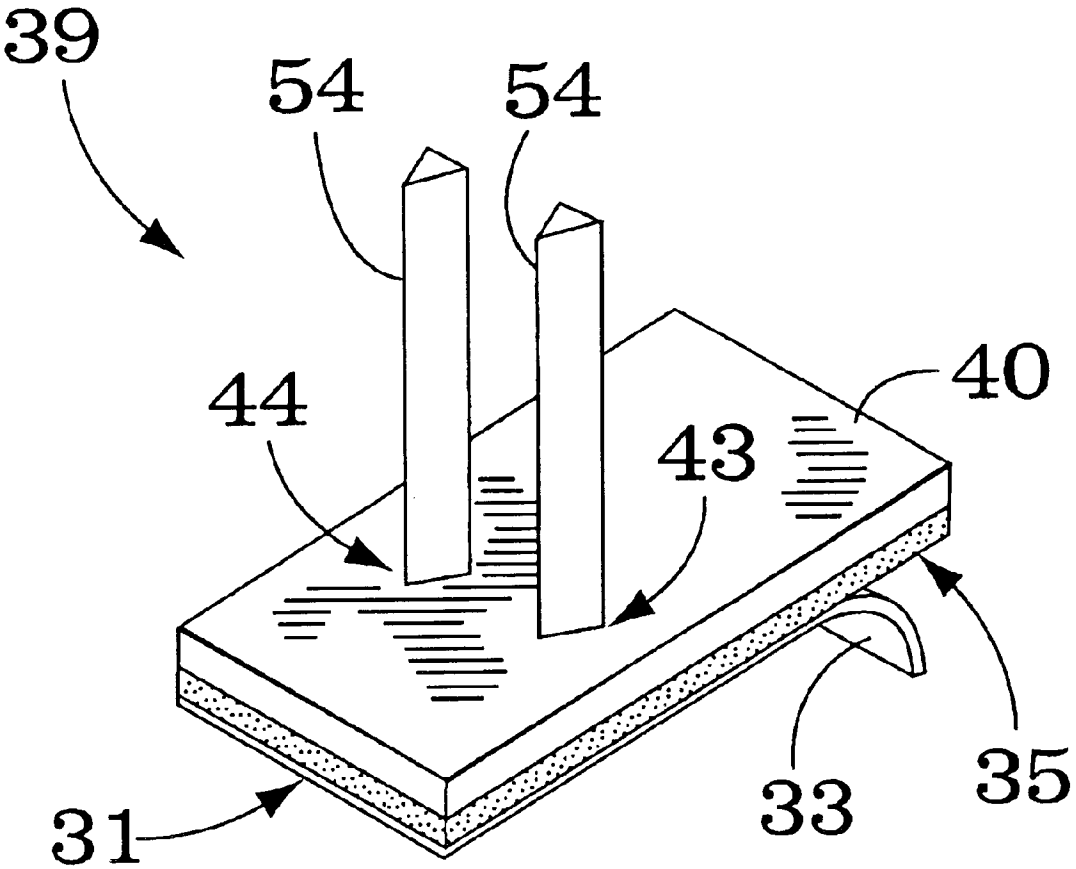
FIG. 12 is an isometric view of another embodiment of a pin support device in accordance with the present invention which illustrates triangular pins.
Figure 13:
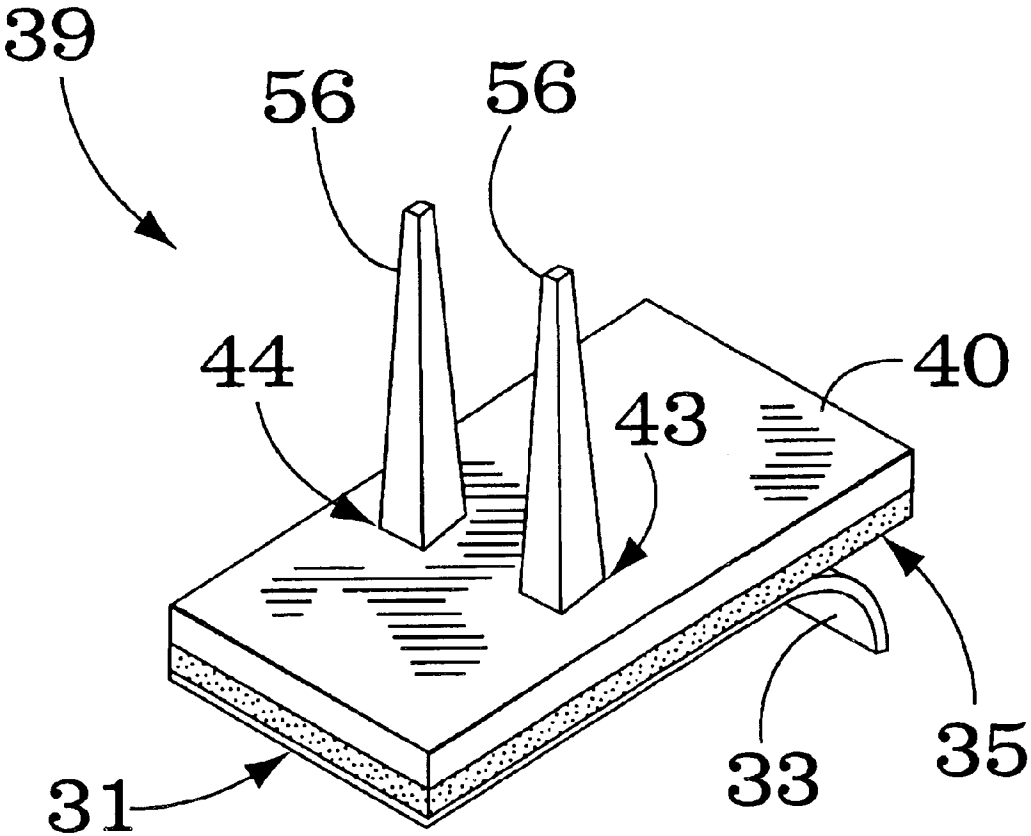
FIG. 13 is an isometric view of another embodiment of a pin support device in accordance with the present invention which illustrates tapered rectangular pins.
Figure 14:
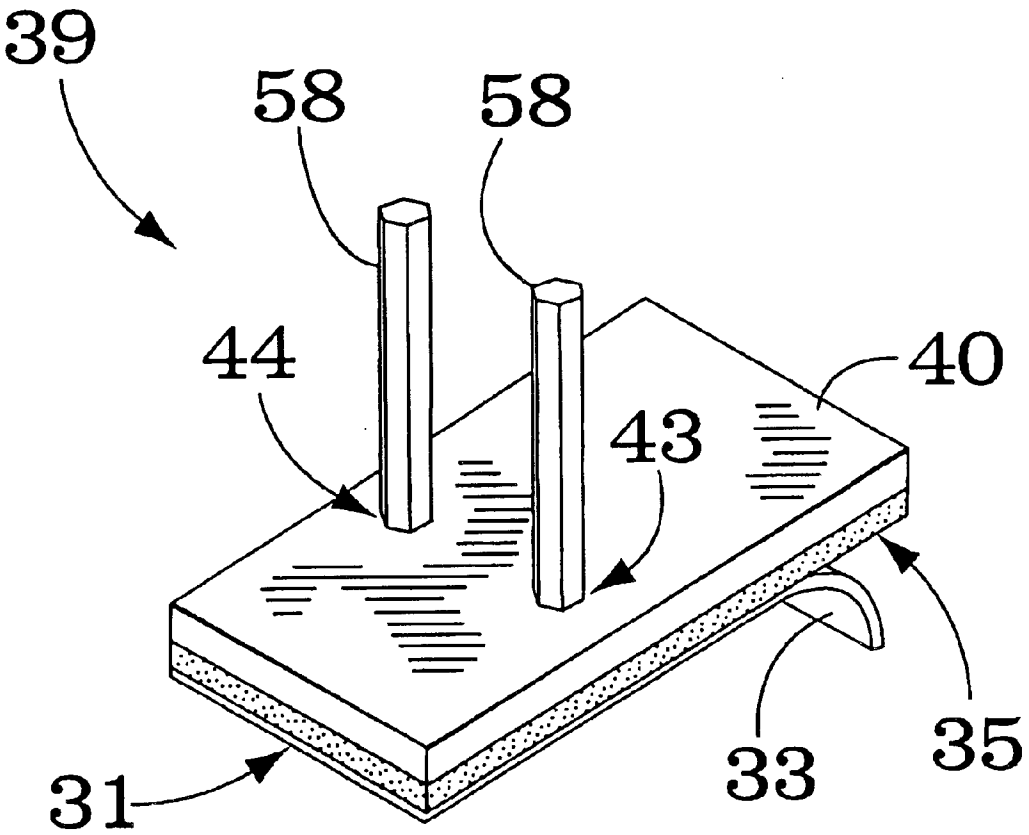
FIG. 14 is an isometric view of another embodiment of a pin support device in accordance with the present invention which illustrates hexagonal pins.

FIG. 8 shows an alternative embodiment of the present invention for use in conjunction with a fall away arrow rest. In this embodiment, the pin support device consists of a base 40 and a pair of pins 41 and 42. The pins or rods are generally cylindrical, but could be other shapes such as ovals, hexagons, squares, rectangles, triangles, and other geometric shapes. Thus, the "pin" could have a cross-section that was rectangular in that its cross-section described a long thin rectangle. The pin shape is preferred since it does not require extra materials and is effective. The additional shapes are for esthetics, and not critical to function. The base and the pins can be made out of any materials known to mankind, including metals such as aluminum, copper, steel, or mixtures or alloys of these. They could also be made from plastic, rubber, polymeric materials, or even wood. The pins 41 and 42 can be made as an integral part of the base 40 such as by molding the whole device from plastic or the pins can be made separately out of, e.g., aluminum, and assembled by joining the pins with the base by pushing the pins into holes 43 and 44 in base 40. Further, the pins need not be uniform in shape like a cylinder and could have other shapes such as, for example, a narrower top and a thicker bottom so that they taper from top to bottom. The tapered pin share 50 is illustrated in FIG. 10, and additional examples of other pin shapes are illustrated in FIGS. 11–14, and include oval-shaped pins 52 (FIG. 11), triangular-shaped pins 54 (FIG. 12), rectangular-shaped pins 56 (FIG. 13), and hexagonal-shaped pins 58 (FIG. 14). A preferred embodiment would involve using tapered pins having one end which are readily inserted into holes in the base and pushed through to engage the larger end in the hole where it is supported and held in place.

Figure 7:
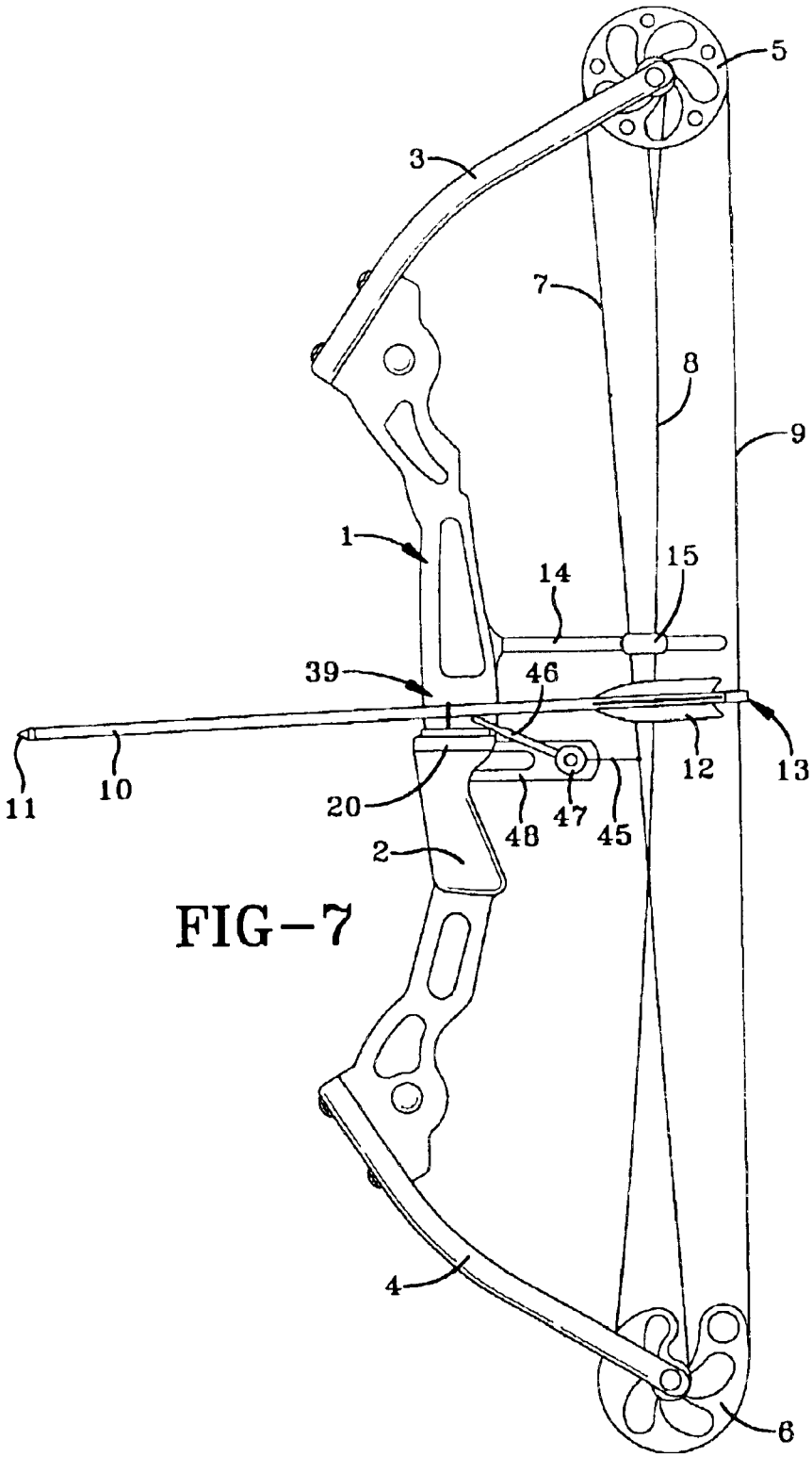
FIG. 7 is a side view in the relaxed position of a bow employing a pin support device in accordance with the present invention.
Figure 9:
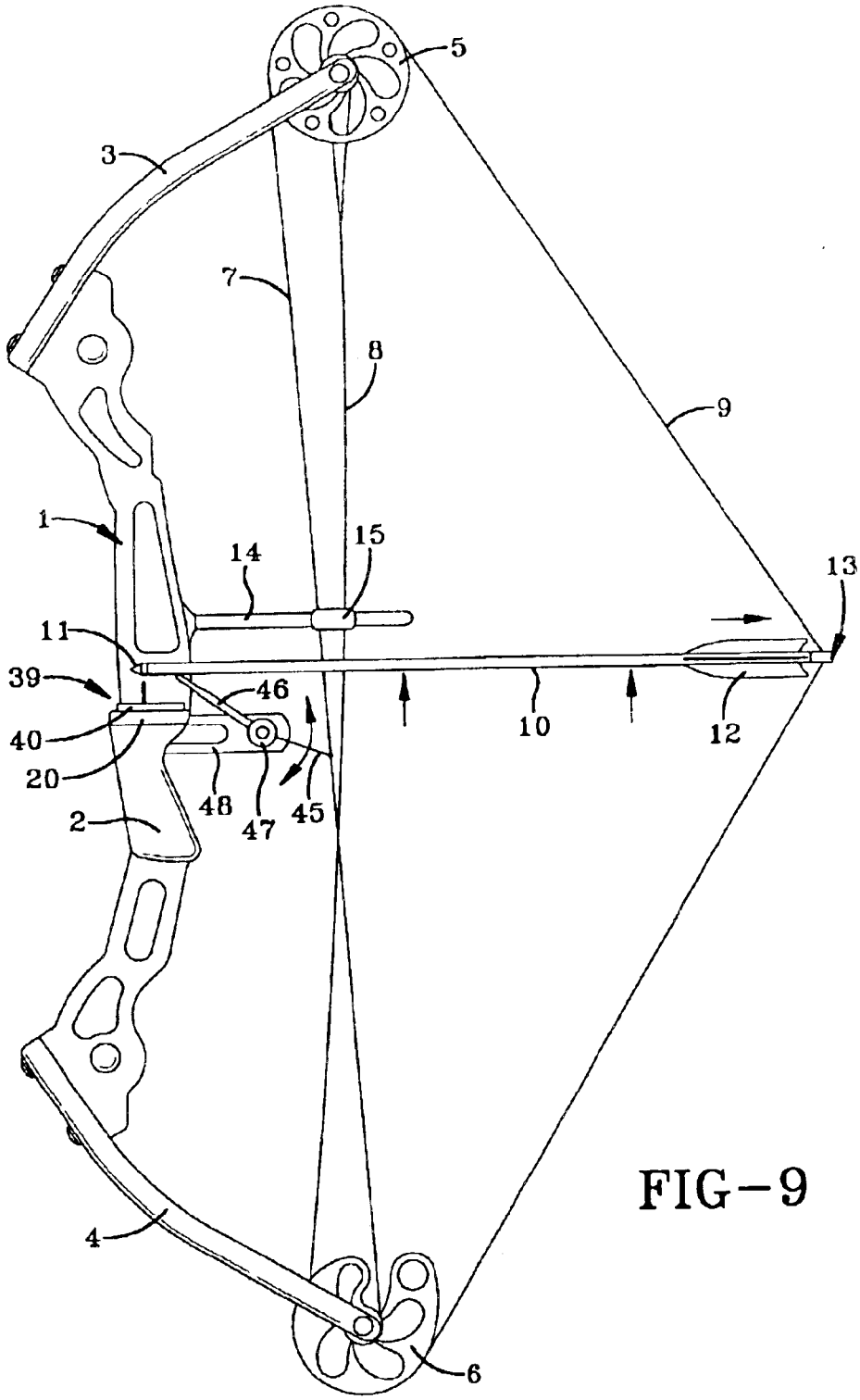
FIG. 9 is a side view of a bow in a drawn position and employing a pin support device in accordance with the present invention.

As shown in FIGS. 7 and 9, when the arrow is in the rest position, as shown in FIG. 7, the pins of the support device will keep the arrow on the arrow rest 46, which in this embodiment is a fall away arrow rest. When in the drawn position, as shown in FIG. 9, actuator cord 45 will pull on the support shaft 47 attached via support 48 to handle 2 and cause the support shaft 47 to rotate. This in turn will cause the arrow rest 46 to rise and with it the arrow (as shown by the arrows under the arrow 10) and place the arrow in position above the height of the pins 41 and 42 of support device 39.

Support device 39 is mounted on arrow rest ledge 30 using a double-sided adhesive foam pad 31 as discussed earlier. As note above, the support device 39 could be mounted using other securing means, such as such as screwing, nailing, using snaps, using magnets, using hook-and-loop fastener, or the like, or need not be attached using a base plate 21, at all. Further, base 40 could be made from two pieces, e.g., two rectangular pieces like the single piece shown, but which are moveably fixed to each other, such as by a pin and slot or other means, so that one of the pieces can be fixed while the other can be moved, e.g., linearly, to adjust the position of the pins 41 and 42. This would allow for adjustment depending upon the length of the arrow being shot. Still further, an adjustable base could be employed for a loop support device as well. Pins 41 and 42 could be attached directly to arrow rest ledge 20 by, for example, fixing pins 41 and 42 to ledge 20 using an adhesive or glue or other bonding composition or by embedding the pins in the upper surface of ledge 20. The benefit of using a base plate is that the guide device can be placed where the user desires it, where it is appropriate if short arrows are being used, and allows modification of the bow after its manufacture. The use of the base plate provides flexibility and versatility. The location of the device 39 on arrow rest ledge 30 is not critical. What is important is that it be located such that pins 41 and 42 will maintain arrow 10 on rest 46 in the rest position and, when arrow 10 is in the drawn position, as shown in FIG. 9, the arrow will be at least three centimeters above the height of the pins. Since pins 41 and 42 are made of materials which can be trimmed once the device 39 is in place so that the height of the pins can be positioned appropriately. The pins are made of a material which is sturdy enough to keep the arrow on the arrow rest, but which can be readily cut or trimmed with scissors or shears or a knife. Further, the spacing of the pins is not critical. Usually, they will be space such that they will accommodate the largest arrow, e.g., a number 2613, or a smaller arrow, such as an ACC. Thus the spacing will be in the range of 5 to 13 millimeters to accommodate a variety of sizes. The spacing need not be overly generous since the arrow when drawn will be above the tops of the pins and will not have to pass through the support device.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby.

What is claimed is:

1. An arrow support device in combination with an archery bow having a drop-away arrow rest, said support device adapted to retain an arrow on said arrow rest and comprising:

a support base, a pair of pins extending perpendicularly from the surface of said support base, said pins being fixed to said support base and defining an opening, the spacing between said pins being adequate to fit an arrow and being in the range of 5 to 13 millimeters and the length of said pins being in the range of 5 to 13 millimeters, the support being placed ahead of the arrow rest and fixed to said bow and said pins being oriented along the length of said bow, whereby an arrow resting on said arrow rest will be supported on said support device and the arrow when it is drawn back and before it is released, will rise vertically from said support device and when released will pass freely above said support without interference from said support.

2. The arrow support device of claim 1 wherein the pins and the support base are molded as one piece.

3. The arrow support device of claim 1 wherein the pins are made from metal, plastic, rubber, polymeric materials, wood, or combinations thereof and are only wide enough to fit an arrow.

4. The arrow support device of claim 1 wherein the pins are generally cylindrical.

5. The arrow support device of claim 1 wherein the pins are cylindrical, oval, hexagonal, rectangular, or triangular in their cross sectional shape.

6. The arrow support device of claim 1 wherein the pins are inserted into the support base.

7. The arrow support device of claim 1 wherein the pins are tapered.

8. The arrow support device of claim 1 wherein the pins are larger than 5 to 13 millimeters and can be trimmed by cutting them with a knife or scissors to a length in the range of 5 to 13 millimeters.

9. The arrow support device of claim 1 wherein the base is moveable to adjust the support device toward the front or rear of the bow.

10. An arrow support device in combination with an archery bow having an arrow rest, said support device being adapted to retain an arrow on said arrow rest and comprising:

a support base;

a loop of spring biased wire extending laterally from one portion of the surface of said support base and back to the surface of said support base, said loop being oriented normal to the arrow on the bow, being attached to said support base and defining a closed loop, the loop being large enough to accept an arrow, the support base being placed ahead of the arrow rest and fixed to said bow, and said loop being spring biased to rotate towards the front of the bow in the direction the arrow passes, whereby an arrow resting on said arrow rest will be supported on said support device and when the arrow is drawn back and before it is released, the loop of said support device will fall off the end of the arrow which will pass freely above said support base without interference from said support base.

11. The arrow support device of claim 10 wherein said loop defines an opening having a diameter in the range of at least 5 to 13 millimeters.

12. The arrow support device of claim 10 wherein the wire is metal, plastic, rubber or combinations thereof.

13. The arrow support device of claim 10 wherein the wire has a thickness of 0.001 to –0.01 inch.

14. The arrow support device of claim 10 wherein the loop has at least one roller which rotates around the axis of the wire.

15. The arrow support device of claim 10 wherein the loop is spring biased to lie flat towards the front of the bow.

16. The arrow support device of claim 10 wherein the base is moveable to adjust the support device toward the front or the rear of the bow.

17. The arrow support device of claim 10 wherein the support device is adhesively fixed to the bow handle.

18. The arrow support device of claim 10 wherein the loop is spring biased using two torsion springs.

19. The arrow support device of claim 10 wherein the loop is spring biased using two flat coil springs.

20. An arrow support device in combination with an archery bow having a drop-away arrow rest, said support device adapted to retain an arrow on an arrow rest and comprising:

a support base, a support means for retaining an arrow on an arrow rest and extending from one portion of the surface of said support base and providing lateral support for an arrow on the bow, while being able to be removed from a support position when the arrow is fully drawn and positioned so as to not interfere in the flight of the arrow when released, said support means being able to accept an arrow, the support means being placed ahead of the arrow rest and fixed to said bow, whereby an arrow resting on said arrow rest, before it is drawn back, will be engaged by said support device, and when the arrow is drawn back and before it is released, the support device is disengaged from the arrow whereby it is allowed to pass freely above said support device without interference from said support device.

* * * * *